United States Patent [19]

Watson

[11] Patent Number: 4,487,577

[45] Date of Patent: Dec. 11, 1984

[54] ADAPTIVE CONTROL FOR THERMAL DRYER

[75] Inventor: John A. Watson, Paducah, Ky.

[73] Assignee: Lecorp, Inc., Lexington, Ky.

[21] Appl. No.: 437,138

[22] Filed: Oct. 27, 1982

[51] Int. Cl.[3] ..... F27B 7/00; F26B 3/08

[52] U.S. Cl. ..... 432/37; 432/58; 34/46

[58] Field of Search ..... 110/245, 346, 224, 204, 110/216; 432/58, 37; 34/46

[56] References Cited

U.S. PATENT DOCUMENTS

| | | | |
|---|---|---|---|
| 2,638,684 | 5/1953 | Jukkola . | |
| 2,666,269 | 1/1954 | Parry . | |
| 2,763,478 | 9/1956 | Parry . | |
| 2,768,629 | 10/1956 | Maul | 34/46 |
| 2,844,886 | 7/1958 | Nathan . | |
| 3,190,627 | 6/1965 | Goins . | |
| 3,238,634 | 3/1966 | Goins . | |
| 3,409,025 | 11/1968 | Wochnowski | 34/46 |
| 3,519,254 | 7/1970 | Putman | 432/37 |
| 3,606,284 | 9/1971 | Hurlbut et al. | 432/37 |
| 3,801,264 | 4/1974 | Lindl | 432/37 |
| 3,905,123 | 9/1975 | Fowler et al. | 34/46 |
| 3,948,277 | 4/1976 | Wochnowski | 34/46 |
| 4,152,110 | 5/1979 | Jukkola et al. . | |
| 4,174,946 | 10/1979 | Rohde . | |
| 4,213,752 | 7/1980 | Seitzer . | |
| 4,241,515 | 12/1980 | Wochnowski et al. | 34/46 |
| 4,245,395 | 1/1981 | Potter . | |

*Primary Examiner*—Henry C. Yuen

*Attorney, Agent, or Firm*—King, Liles and Schickli

[57] ABSTRACT

An adaptive control system for a bulk material dryer measures the thermal demand of bulk material to be dried in a dryer and adjusts the thermal output of the dryer to match the measured demand. The system contemplates that the dryer will require a response period to fully meet a change in demand and coordinates the introduction of material into the dryer with that response time. The system is automatically responsive to changes in both the moisture level and mass flow rate of the bulk material to be dried, adjusting the thermal output of the dryer to changes in each of these variables. The system preferably includes a feedback sensor used to make final adjustments in the dryer output.

5 Claims, 1 Drawing Figure

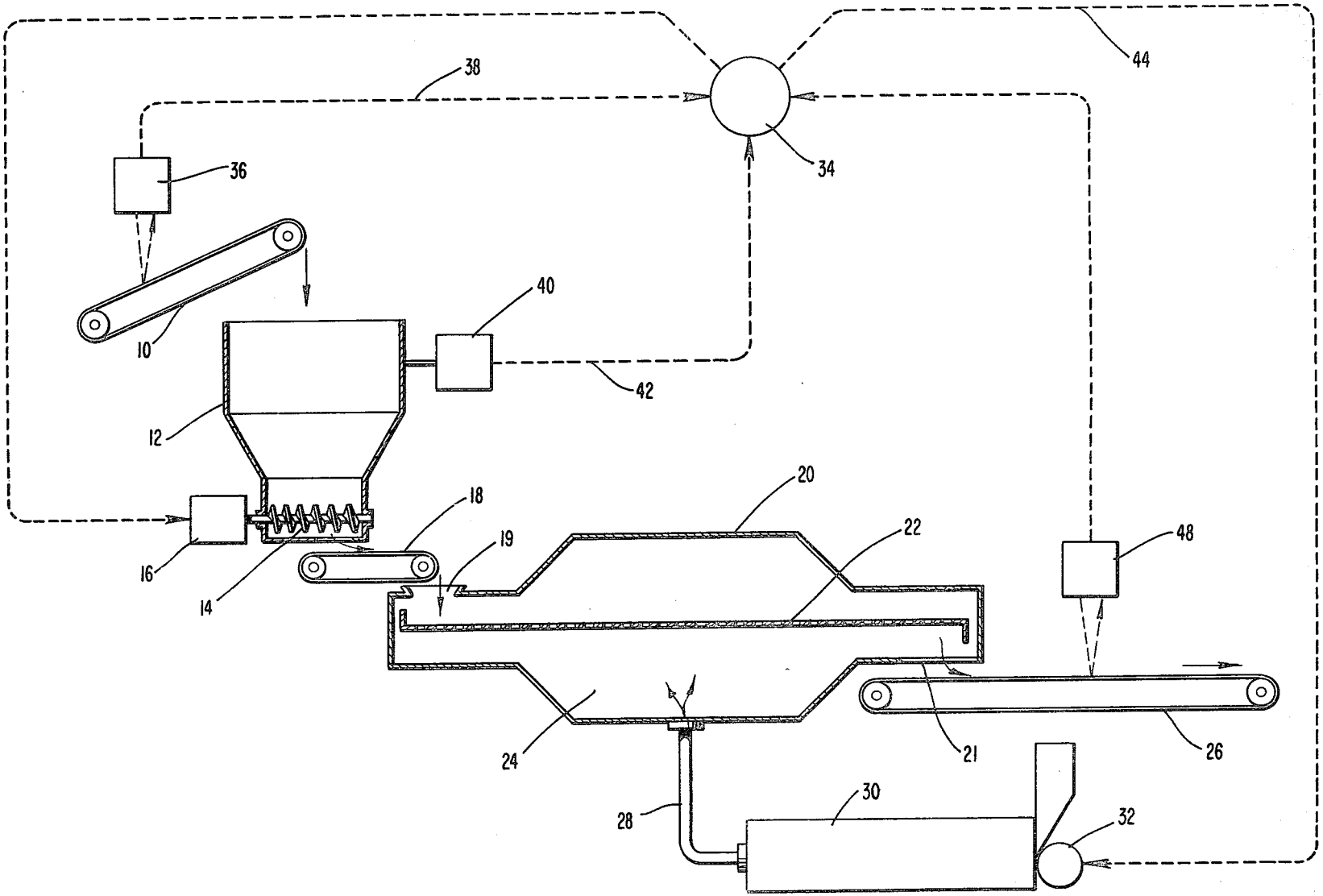
44
48
26
32
21
22
30
34
20
42
28
40
24
19
38
18
14
36
10
12
16

ADAPTIVE CONTROL FOR THERMAL DRYER

BACKGROUND OF THE INVENTION

The invention relates to thermal dryers and more particularly concerns an adaptive control for a thermal dryer enabling it to respond to a change in thermal demand in the drying of bulk solid material. The invention will be specifically disclosed by way of example, in connection with a thermal dryer for removing moisture from fine particles of washed coal.

In the processing of coal, it is desirable, and often mandatory, to remove a number of impurities from the coal prior to use. The need to remove these impurities has increased in recent years with the advent of modern mining techniques. Although these modern mining techniques are highly efficient and permit high production rates, they tend to be less descriminating than older mining techniques in the collection of material from the ground. As a result, coal mined by many of these modern techniques tends to have an even greater amount of impurities than was common several years ago. As a result, the need to process coal through a cleaning process to remove impurities has been accentuated in recent years.

There are a number of processes for removing impurities from the coal. In general, these are washing type processes which leave the coal wet. It is then necessary to remove moisture from the cleaned coal through a thermal dryer or the like.

The most common approach to drying wet coal is to use a fluidized dryer where hot gases are forced through an orifice plate within the dryer resulting in a large pressure drop and fluidizing a bed of material being moved through the dryer on top of the plate. Control is a major problem in the prior art drying systems of this type. Most controlled prior art systems use the discharge gas temperature as the controlled variable on the assumption that this parameter provides a good indication of moisture content of the material being dried. If conditions of infeed to the system remain constant, this assumption would generally hold true. However, infeed conditions do not remain constant in many applications and changes in the mass flow rate into the system alter the thermal demand placed on the dryer. This alters the operating set point on these types of dryer systems and requires skill and experience on the part of operators to judge the level of a new set point. The set point is generally based upon the subjective impression of the operator as to appearance of the coal feeding into the system. As a result, coal is frequently dried beyond specification to insure that it is acceptable. This overdrying of the coal results in a considerable waste of energy and money, especially when oil or gas fuel is being used to supply the drying heat.

Another problem resulting from poor control, and especially downstream control, is that sudden swings in the thermal load on the dryer are not accommodated by the control system. As a result, the coal is frequently either underdried, resulting in a wet product, or overdried, resulting in a waste of energy and possibly a fire in the dryer. These swings or fluctuations in the thermal load normally result from breakdown or blockages in the system upstream of the dryer.

SUMMARY OF THE INVENTION

Accordingly, it is a primary object of the present invention to provide an automated system for drying bulk material to a predetermined specification.

It is another object of the present invention to provide a system for anticipating the thermal demands for drying a selected quantity of bulk material and adjusting a dryer to accommodate those demands.

Another object of the present invention is to match the thermal output of a dryer with the thermal demands of a selected quantity of bulk material by coordinating the thermal response time of the dryer with the entry of the selected material.

Still another object of the present invention is to provide a control system that matches the thermal load of bulk material supplied in varying quantities and moisture content with the thermal output of a dryer.

Yet another object of the present invention is to provide a control system that will accommodate the handling of small wet particles of bulk material tending to form agglomerations.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved control system is provided for drying bulk material. The system includes a thermal dryer for drying the bulk material and means for continuously moving a quantity of bulk material through the dryer. The dryer includes associated means for removing moisture from the bulk material at a variable rate. The system senses the thermal load represented by material upstream of the dryer and adjusts the rate of the moisture removing means to accommodate the sensed thermal load as the selected material is moved through the dryer.

The control system of the invention includes means for coordinating the movement of the selected quantity of material with response time of the moisture removing means to pass a selected quantity of material through the dryer after the moisture removing means has fully responded to the sensed thermal load.

According to a more specific aspect of the invention, the control system senses both the moisture content of the selected material and its mass flow rate.

In a further aspect of the invention, a further moisture sensing means is provided downstream of the dryer for modifying the rate of the moisture removing means in response to moisture content of the material after it has passed through the dryer.

The invention further contemplates the use of a temporary storage area for holding bulk material after its load has been sensed but prior to entering the dryer. Under steady state conditions, the system removes the bulk material from the temporary storage area for delivery to the dryer at the rate bulk material is supplied to the temporary storage area. However, the rate for removing material from the temporary storage area for delivery to the dryer is altered only after a time delay allowing the dryer to respond to the newly created thermal demands created by a change in mass flow rate.

Still other objects of the present invention will become readily apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention, and together with the description, serves to explain the principles of the invention. The sole drawing FIGURE is a schematic depiction of a control system in accordance with the present invention specifically designed to handle and dry small wet coal particles following a washing process.

Reference will now be made in detail to the present preferred embodiment of the invention, an example which is illustrated in the accompanying drawing.

BEST MODE OF CARRYING OUT THE INVENTION

Reference is now made to the drawing which schematically depicts a dryer control system for drying bulk solid material in accordance with the present invention. Bulk solid material in the form of wet coal particles from a coal washing process is transported upon a transport conveyor 10 for deposit into a relatively small covered live bottom surge hopper 12. In the preferred embodiment, this relatively small surge hopper 12 has a full capacity of approximately 5 tons of wet coal fines.

The entire bottom of the surge hopper 12 is a variable rate volumetric screw type feeder 14 including a series of feed screws discharging to a common screw on the side of the hopper 12. The common screw feeds material at controlled rate and is driven by a DC motor and an SCR controller 16 to remove coal from the bottom of the surge hopper 12 for delivery to a dryer feed 18. The dryer feed 18 then further directs and transports the bulk coal material into the inlet 19 of a thermal dryer 20, which in the preferred embodiment is a 5 ft. by 25 ft. vibrating fluidized bed type thermal dryer. A preferred dryer is the Carrier Model Q dryer manufactured by Rexnord of Louisville, Ky.

Vibratory motion applied to the dryer 20 in a well known conventional manner moves the bulk coal material from the inlet 19 to an outlet 21 across a perforated bed plate 22 centrally disposed in the dryer 20 and having a plurality of flow orifices extending therethrough. A hot gas plenum 24 is disposed beneath the bed plate 22 for evenly distributing pressurized air beneath the plate 22 and insuring substantially uniform gas flow through the plurality of flow orifices. As the hot gas from the plenum 24 flows through the plurality of flow orifices, the coal material atop the plate 22 is fluidized in a bubbling type action as it is moved from the inlet 19 to the outlet 21. The bulk coal material is discharged from the dryer 20 onto an outlet conveyor 26 for removal as a dry product.

Heated gas for drying the wet coal product in the thermal dryer 20 is supplied to the plenum 24 through a conduit 28 communicating with a burner 30. The fuel feed of the burner 30 is controlled by a burner control 32 to vary the heat of the burner and thus the moisture removing capacity of the heated gas. The operation of the burner control 32 is, in turn, dictated by a programmable controller 34 through a control signal applied through communication line 44. The programmable controller 34 may be of any of several well known commercial models as, for example, the Modicon 584 model sold by Modicon Division of Gould, Inc. of Andover, Mass.

It is obviously important to dry the bulk material processed through the dryer 20 to a predetermined level. It is equally important to avoid overheating the meterial. At best, overdrying the material results in a needless expenditure of energy and may lead to many more serious consequences, such as overheating of the dryer 20 or combustion of the coal bulk material.

The problem of establishing an appropriate dryer setting is compounded since, in a typical bulk material drying process, such as the described coal drying process, the material to be dried by the system is nonuniformly input into the drying system in varying quantities and with varying moisture content. The thermal demands placed upon the dryer 20 are thus varied accordingly throughout the process. The present invention is directed to an adaptive control system for drying bulk materials under such varying conditions, a system that anticipates thermal demand on the dryer 20 and controls the dryer 20 to accommodate the varying demands.

Under steady state operating conditions with constant moisture level and constant mass flow rates, the feed rate of the variable rate volumetric feeder 14 delivering bulk material from the surge hopper 12 to the dryer 20 is matched to the mass flow rate of material supplied to the surge hopper 12 on transport conveyor 10. Normally, under these steady state conditions, the surge hopper 12 would remain approximately half full.

As the wet material is infed into the surge hopper 12 upon the transport conveyor 10, the moisture level is detected at an upstream location by a moisture sensor 36 which inputs this measured information into the programmable controller 34 along a communication line 38. The moisture sensor 36 may be an IR scanner type moisture indicator such as Anacon Model 1106 manufactured by Anacon, Inc. of Burlington, Mass. The surge hopper 12 also has a weight sensor 40 which may be in the form of a Kistler-Morse load cell manufactured by Kistler-Morse of Bellevue, Wash., through which the hopper is suspended from a structural steel frame. The weight measurement from this sensor 40 is also input to the programmable controller 34 along a communication line 42.

In the event that the moisture level of the material on transport conveyor 10 changes, the change is detected by the moisture sensor 36 and communicated to the programmable controller 34. As represented by communication line 44 in the drawing, the programmable controller dictates the operation of the burner control 32 to vary the fuel feed to the burner. The signal transmitted from the programmable controller 34 to the burner control 32 is the product of the inputs of the moisture and weight sensors multipled by an appropriate proportionality factor. An increase or decrease in the moisture level detected by sensor 36 upstream of the dryer 20 will thus result in a proportional increase or decrease in the burner (30) fuel feed rate (assuming constant mass flow rate). Similarly, an increase or decrease in the mass flow rate detected as a weight change by sensor 40 will result in a proportional increase or decrease in the burner (30) fuel feed rate (assuming constant moisture level).

Typically, burners have required some response period before they can increase thermal output. As noted above, the surge hopper 12 of the preferred embodiment is normally maintained approximately ½ full. This level is calculated in the preferred embodiment to create a selected lag time between the introduction of bulk material into the surge hopper 12 and outfeed through the variable rate feeder to the dryer 20 and to accommodate surges in the mass flow rate. The time lag associated with this level in the preferred embodiment roughly corresponds to the thermal response time of the burner 30 and insures that the burner 30 will have reached the desired operating temperature by the time the material of increased (or decreased) moisture level reaches the dryer 20.

The system similarly responds to an increase or decrease in the thermal demand of the dryer 20 form a change in the mass flow rate of bulk material into the surge hopper 12. Normally, the motor and controller 16 adjusts the screw type feeder 14 to output bulk material from the surge hopper 12 at the same rate material is infed by the transport conveyor 10. With the infeed and outfeed rates being equal, the weight of material in the surge hopper 12 remains substantially unchanged. An increase or decrease in the mass flow rate into the surge hopper 12 will initially result in a disparity between infeed and outfeed rates and a corresponding increase or decrease in the weight of material stored in that surge hopper 12. This weight change is detected by the weight sensor 40 and communicated to the programmable controller 34 along communication line 42. The resulting change of the product of the values from the moisture and weight sensors 36 and 40 changes the output signal of the controller 34 along communication line 44 to modify operation of the burner control 32, increasing or decreasing the fuel input therefor to properly meet the anticipated thermal load requirements of the burner for the new increased or decreased mass flow rate.

As mentioned above, the burner 30 has a response time before it can fully meet the anticipated and measured future demand. Thus, it is not desirable to change the mass flow rate of material into the dryer 20 until the burner 30 reaches its new setting. For this reason, a signal output from the programmable controller 34 to the motor and controller 16 commanding the variable rate feeder 14 to once again match the mass flow rate of the feeder 14 to the bulk material input is delayed for a time corresponding to the thermal response period of the burner 30. This response period also roughly corresponds to the residence time of the bulk material in the surge hopper 12 so that the increased or decreased feed rate into the dryer is delayed by the response period of the burner 30. Thus, the input of material to the dryer 20 is coordinated with the operation of the burner 30 for both changes in moisture level and changes in mass flow rate.

It is seen that applicant's invention anticipates a thermal load to be placed upon the dryer 20 and automatically adjusts the dryer conditions to meet those demands. Moreover, the system compensates for a thermal response lag in the burner and coordinates that response lag with the input of material to the dryer 20. As previously noted, the system accommodates not only changes in the moisture level of material to be dried, but also changes the mass flow rate of material. In the described embodiment, applicant accommodates the response lag and variable input of wet bulk material by use of a temporary storage area during the response period of the burner. Significantly, however, the control system minimizes the storage requirements for the temporary storage area permitting the use of a relatively small surge hopper 12. Minimizing the size of the surge hopper 12 is especially important when the bulk material consists of certain fine wet particles, such as coal fines which have a strong tendency to form agglomerations. Handling of such wet coal fines is extremely difficult and storage in a relatively large hopper is undesirable.

A further moisture sensor 48 is located downstream of the dryer above the output conveyor 26 and used to detect the moisture level of material leaving the dryer 20. This further moisture sensor serves as a check and control refinement for the system to insure that the material is being dried to specification. There is a tendency for highly responsive control systems to unnecessarily fluctuate with small changes in thermal demand and to initially overshoot needed requirements. The feedback signal from moisture sensor 48 is input to the programmable controller 34 to reduce this tendency. When the sensor 48 senses that the dryer demand setting predicted by sensors 36 and 40 is not drying the material within specification, it trims or modifies the control signal applied to the burner 32 by altering the proportionality factor applied against the product of the values of these two earlier sensors 36 and 40.

Since the burner 30 generally gradually increases or decreases thermal output through its response time, there is likely to be some minimal overdrying or underdrying during the response or transition period between the burner settings. Thus, within a certain predetermined range, the signal generated by moisture sensor 48 is ignored by the programmable controller 34 until the material creating that new thermal demand has had adequate time to pass through the dryer 20. After an appropriate lag time, the signal generated by moisture sensor 48 is compared to a desired level with deviations being used to adjust the command signal to the burner control 32 by adjusting the proportionality factor as described above. It is highly preferable, however, to program the controller 34 to recognize certain extreme signals from the moisture sensor 48 outside the predetermined limits even during the burner transition period and to override and adjust the control signal to the burner control. Recognizing extreme signals from the moisture sensor 48 during the transition period will serve to avoid serious overdrying and underdrying problems.

In summary, numerous benefits have been described which result from employing the concepts of the invention. The invention contemplates an adaptive control system for a bulk material drying system that senses an anticipated thermal load for the dryer and adjusts the dryer to meet those anticipated demands. The invention further contemplates that the dryer will require some response time and coordinates the introduction of material to the dryer with that response time. The control system of the invention is responsive to both the moisture level and the mass flow rate of the wet material to be dried. It accommodates surges in the supply of material to the drying system with minimal temporary storage requirements to greatly facilitate the handling of fine particulate material having a tendency to agglomerate.

The invention also contemplates the use of a feedback signal used to modify a control signal to the heating means and minimizes unnecessary fluctuations in the control.

The foregoing description of the preferred embodiments of the invention has been presented for purposes of illustration and description. It is not intended to be exhaustive or to limit the invention to the precise form disclosed. Obvious modifications or variations are possible in light of the above teachings. The embodiments were chosen and described in order to illustrate the principles of the invention and its practical application to enable one of ordinary skill in the art to utilize the invention and the various embodiments and with various modifications as they are best suited to the particular use contemplated. It is intended that the scope of the invention be defined by the claims as appended hereto.

I claim:

1. An adaptive control system for a bulk material drying system, comprising:

(a) a thermal dryer for drying bulk material;

(b) means for substantially continuously moving a quantity of bulk material through the thermal dryer from a position upstream of the dryer to a position downstream of the dryer;

(c) means associated with said thermal dryer for removing moisture from the bulk material at a variable rate as the material is moved through the dryer;

(d) means located upstream of the dryer for sensing the thermal load to be placed on the dryer including the moisture content and the mass flow of a selected quantity of material upstream of the dryer;

(e) means responsive to said sensing means for adjusting the rate of the moisture removing means to accommodate the sensed thermal load of the selected material as the selected material is moved through the dryer;

(f) a temporary storage area for holding the bulk material after its thermal load is sensed but prior to entering the dryer;

(g) means for removing the bulk material from the temporary storage area for delivery to the dryer at the approximate rate the bulk material is supplied to the temporary storage area; and (h) said mass flow sensing means including means for sensing the weight of the bulk material in the temporary storage area.

2. An adaptive control system as recited in claim 1 further including means for coordinating the movement of the selected quantity of material with a response time of the moisture removing means in order to pass the selected quantity of material through the dryer after the moisture removing means has responded to the thermal load sensing means.

3. An adaptive control system as recited in claim 1 further including moisture sensing means downstream of the dryer for modifying the adjusting rate means in accordance to moisture in the material after it has passed through the dryer.

4. An adaptive control system for a bulk material drying system, comprising:

(a) a thermal dryer for drying bulk material;

(b) means for substantially continuously moving a quantity of bulk material through the thermal dryer from a position upstream of the dryer to a position downstream of the dryer;

(c) means associated with said thermal dryer for removing moisture from the bulk material at a variable rate as the material is moved through the dryer;

(d) means located upstream of the dryer for sensing the thermal load to be placed on the dryer including the moisture content and the mass flow of a selected quantity of material upstream of the dryer;

(e) means responsive to said sensing means for adjusting the rate of the moisture removing means to accommodate the sensed thermal load of the selected material as the selected material is moved through the dryer;

(f) a temporary storage area for holding the bulk material after its thermal load is sensed but prior to entering the dryer;

(g) means for removing the bulk material from the temporary storage area for delivery to the dryer at the approximate rate the bulk material is supplied to the temporary storage area; and (h) means for adjusting the rate at which the bulk material is removed from the temporary storage area in accordance with the mass flow rate of the bulk material into the temporary storage area after a time delay roughly corresponding to the residence time of the bulk material in the temporary storage area.

5. An adaptive control system as recited in claim 4 wherein said dryer is of the fluidized bed type and said moisture removing means includes a burner supplying hot gases to the fluidized bed type dryer.

* * * * *